US007690121B2

(12) United States Patent
Lam et al.

(10) Patent No.: US 7,690,121 B2
(45) Date of Patent: Apr. 6, 2010

(54) INVERTIBLE PUNCH TOOL

(75) Inventors: Luc Chuong Lam, Madison, WI (US); Kevin Donald Schmidt, Sun Prairie, WI (US); Craig Alan Schultz, Madison, WI (US)

(73) Assignee: Fiskars Brands, Inc., Madison, WI (US)

( * ) Notice: Subject to any disclaimer, the term of this patent is extended or adjusted under 35 U.S.C. 154(b) by 851 days.

(21) Appl. No.: 11/228,141

(22) Filed: Sep. 16, 2005

(65) Prior Publication Data

US 2007/0062358 A1 Mar. 22, 2007

(51) Int. Cl.
*B26D 1/12* (2006.01)

(52) U.S. Cl. ..... 30/363; 83/685; 30/315; 30/358

(58) Field of Classification Search ..... 83/682, 83/684, 685, 669, 698.11, 698.41, 686; 30/315, 30/316, 300, 310, 363, 361, 358; D19/72
See application file for complete search history.

(56) References Cited

U.S. PATENT DOCUMENTS 3,579,217 A * 5/1971 Casey et al. ..... 340/635
3,714,857 A * 2/1973 Stuertz et al. ..... 83/468
3,958,329 A * 5/1976 Mundy ..... 30/97
4,428,709 A * 1/1984 Peters ..... 414/412
5,701,782 A * 12/1997 Padula ..... 72/452.4
D419,178 S 1/2000 Kim et al.
6,742,431 B1 6/2004 Oh
6,752,058 B2 6/2004 Oh
6,823,764 B1 * 11/2004 Tsubota ..... 83/249
D511,356 S 11/2005 Oh
7,249,551 B1 * 7/2007 Ray ..... 83/631
2002/0124420 A1 9/2002 Hsuan
2003/0037657 A1 2/2003 Oh et al.
2003/0205122 A1 11/2003 Oh
2004/0129124 A1 7/2004 Chan

OTHER PUBLICATIONS

Fiskars School Office Craft catalog, Jul. 2004, pp. 71-78.

* cited by examiner

*Primary Examiner*—Boyer D Ashley
*Assistant Examiner*—Omar Flores-Sánchez
(74) *Attorney, Agent, or Firm*—Foley & Lardner LLP

(57) ABSTRACT

A punch tool for the punching of a shape through a sheet of material. The punch tool includes a punch and a die portion disposed within a housing having a slot for receiving a sheet of material. A lower ramp is disposed within the housing and, when rotated, raises the punch to engage the die. The lower ramp may be rotated regardless of the orientation of the punch tool. Thus, the punch tool may be used even when in an inverted position.

20 Claims, 3 Drawing Sheets

INVERTIBLE PUNCH TOOL

TECHNICAL FIELD OF THE INVENTION

The present invention relates generally to punch devices. In particular, the present invention relates to a punch apparatus that can be used both right-side up and upside down.

BACKGROUND OF THE INVENTION

A variety of punch tools for punching holes and designs through sheets of material are commercially available. For example, conventional triple punch tools are used to simultaneously punch three holes through sheets of material at spaces to allow for the placement of the material in a three ring binder. However, such punch tools are generally bulky and difficult to handle.

Generally, such punch tools possess a top portion which acts as an actuator to, when depressed, move a punch through a die disposed between the top portion and a base. For example, conventional punch tools often have a base designed to rest on a work surface and a top portion which is designed to pivot about an axis to depress the punch. Generally, a spring member biases the punch and the pivotable top. Unfortunately, however, the system makes actuation of the device more difficult for a user. Thus, such a punch tool is difficult to use as a handheld tool. The pivoting motion can be awkward to handle, particularly for someone with small hands, such as a child. In addition, it is often difficult to align material in the punch tool, as it is only operable in one orientation, i.e. flat on a work surface.

Some punch tools known in the art are designed as "palm punches". Generally, such punches have a small form factor, normally only including one punch. The mechanism to actuate the punch is normally a spring biased button, or the top portion is spring-biased, which the user depresses, thus pressing down on the punch and moving it through the die. However, such punches often are not amenable for use on a work surface nor easily usable with one hand due to the need to orient the punch upright prior to usage.

Currently available punches are difficult to utilize in an inverted position, i.e. when the base is located on top and the top portion is located on the bottom. Thus, there is a need for a punch tool that is capable of operating in both a normal and an inverted position and to be used while resting on a work surface for additional support.

SUMMARY OF THE INVENTION

The present invention relates to a punch tool that is operative a plurality of orientations. The punch tool has a housing containing a punch and dye mechanism. The housing has a die portion with a cutout region adapted to receive a sheet of material. The housing has a cutout region or slot for insertion of material to be punched. The cutout region has a lower surface and an upper surface each capable of supporting a sheet of material to be punched.

These and other objects, advantages, and features of the invention, together with the organization and manner of operation thereof, will become apparent from the following detailed description when taken in conjunction with the accompanying drawings, wherein like elements have like numerals throughout the several drawings described below.

DETAILED DESCRIPTION OF THE PREFERRED EMBODIMENTS

Figure 1:
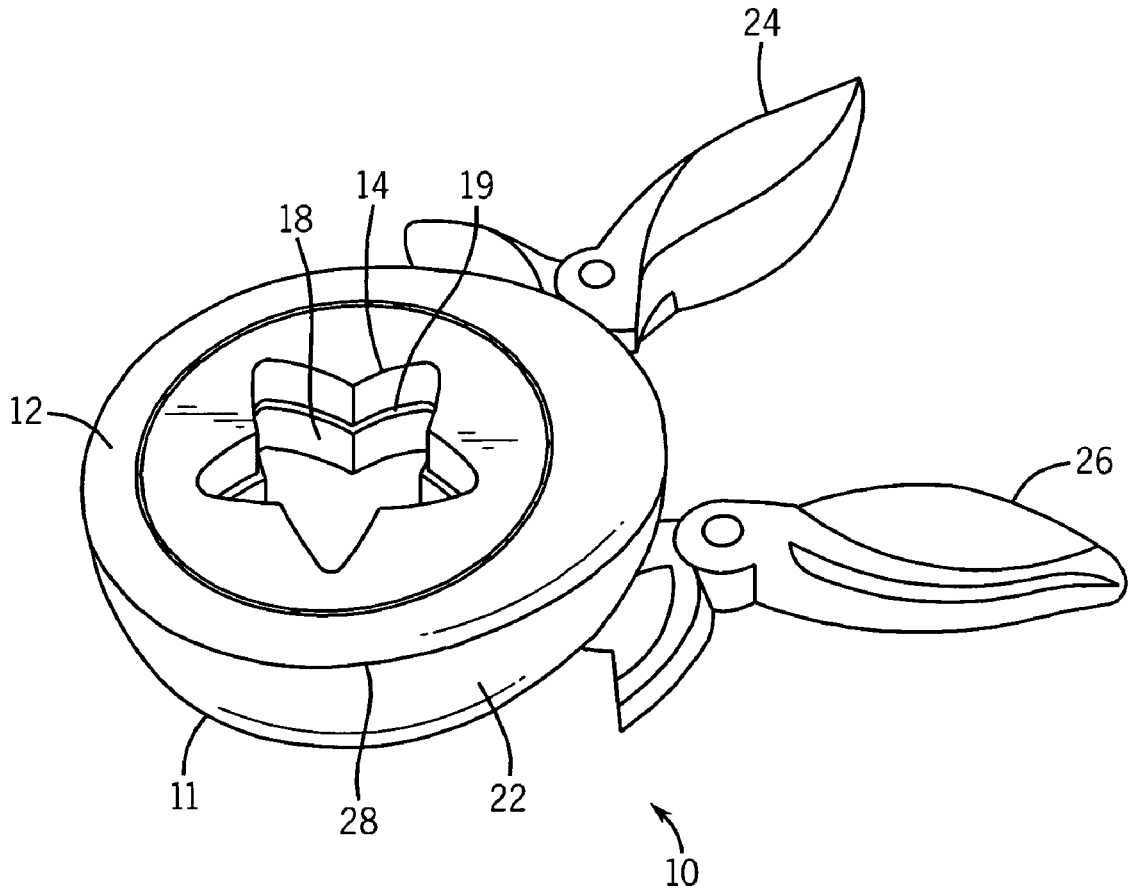
FIG. 1 is a perspective view of a punch tool constructed according to one embodiment of the present invention.
Figure 2:
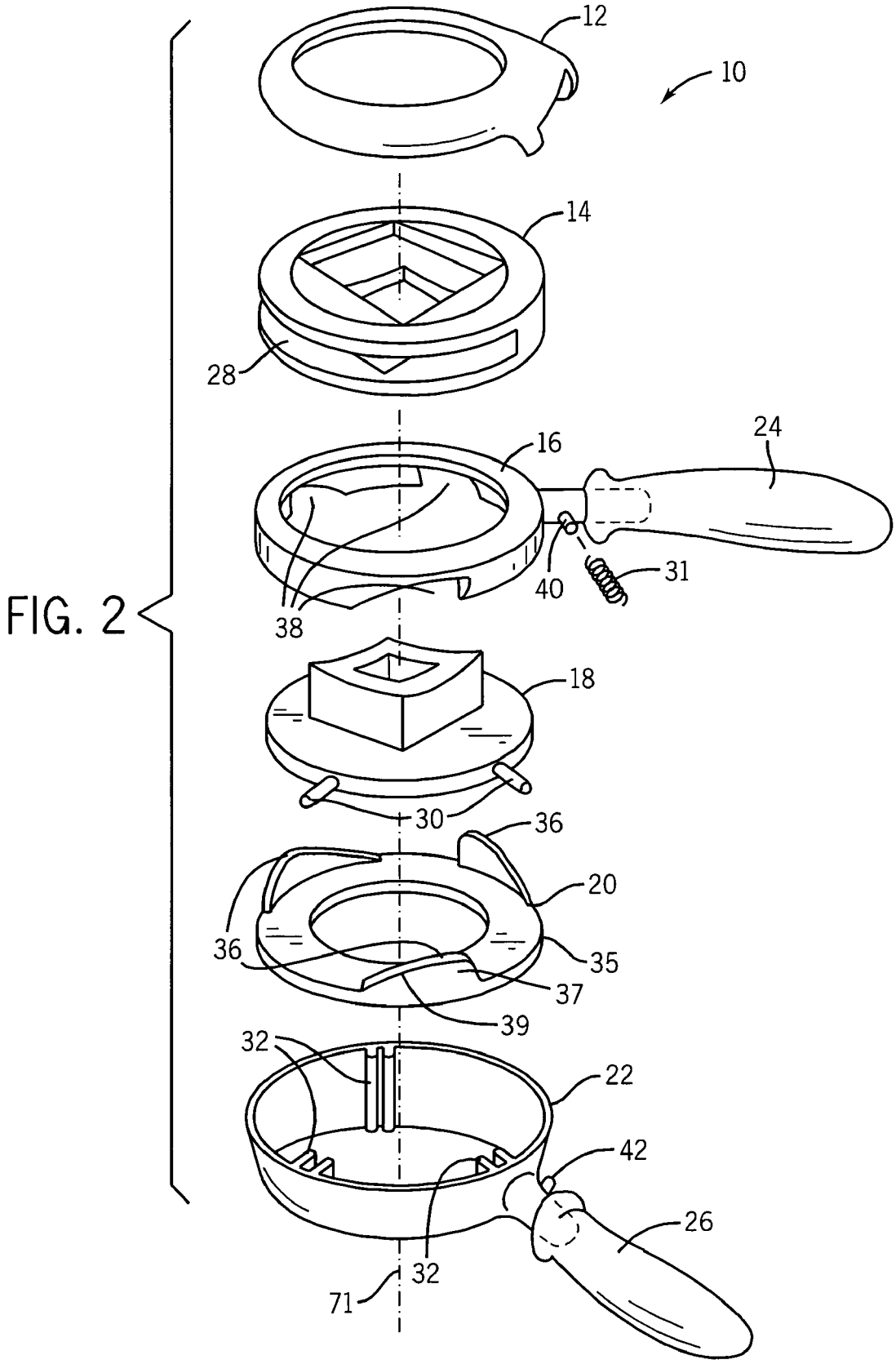
FIG. 2 is an exploded view of a punch tool of FIG. 1.

The present invention relates to a punch tool that is operable in a plurality of orientations. As illustrated in FIGS. 1-2, the punch tool 10 includes a housing 11. The housing 11 has a punch and die mechanism 13 which comprises a die 14 and a punch 18 in operative communication with each other. The die 14 has a cutting edge 19 with a predetermined shape. In one embodiment of the present invention, the punch and die mechanism 13 is easily removable to allow a user to select various shapes and or sizes for use in various applications. Various punch and die structures can be utilized with the present invention. The punch 18 is designed to operably engage the die 14 to cut a hole of the predetermined shape in a sheet of material (not shown). In one exemplary embodiment, more than one sheet of material may be cut at once. In one exemplary embodiment, the material to be punched is paper.

The punch tool 10 of the present invention includes a mechanism for actuating the punch 18 through the die 14 regardless of the orientation of the punch tool 10. As shown in FIG. 2, in one embodiment the housing 11 comprises an upper portion of the housing 12, an upper ramp 16, a lower ramp 20, and a lower portion of the housing 22. The die 14 is positioned between the upper housing 12 and the upper ramp 16, with a slot or opening 28 in the housing 11 and die 14 to allow for insertion of the material to be punched. The punch 18 is positioned between the upper ramp 16 and the lower ramp 20. The punch 18 and lower ramp 20 are substantially disposed between the lower housing 22 and the upper ramp 16. In one embodiment, the lower ramp 20 and the upper ramp 16 are rotatable relative to the punch 18 and die 14 and the upper housing 12 and lower housing 22.

In the exemplary embodiment shown in FIG. 2, the punch 18 includes at least one peg 30 for engaging corresponding grooves 32 in the lower housing 22. The punch 18 is rotationally fixed (about the Z-axis 71) within the lower housing 22 but adapted to move vertically (i.e. along the Z-axis 71) within the lower housing 22 along the grooves 32. In one embodiment, the lower ramp 20 includes a base plate 35, upon which the punch 18 is seated, and at least one wedge 36. In one embodiment, the at least one wedge 36 is substantially triangular or pyramidal in shape with a base formed by the base plate 35, an upright leg 37, and a diagonal leg 39 therebetween. In a particular embodiment, the at least one wedge 36 includes at least three wedges spaced equidistant around the perimeter of the lower ramp 20, and the punch 18 includes at least three corresponding pegs 30 positioned around the perimeter of the punch 18. The at least one peg 30 engages the at least one wedge 36 and is adapted to travel along the diagonal leg 39 of the at least one wedge 36 as the at least one wedge 36 is rotated relative to the housing 11. Thus, as the lower ramp 20 rotates, the at least one wedge 36 is rotated relative to the punch 18, and the at least one peg 30 is raised, raising the punch 18 relative to the housing 11. In one embodiment, the at least one peg 30 is positioned at the base of the at least one wedge 36 and moves along the diagonal leg 39 as the lower ramp 20 is rotated.

In one embodiment, the upper ramp 16 includes at least one cutout portion 38 corresponding to and adapted for engaging the at least one wedge 36 of the lower ramp 20. While the cutout 38 may be of any shape or size capable of engaging the at least one wedge 36, in one embodiment the at least one cutout 38 is of a corresponding shape to the at least one wedge 36 wherein the cutout 38 engages the vertical leg 37 of the at least one wedge 36. Thus, the upper ramp 16 and lower ramp 20 are in operative communication so that rotation of the upper ramp 16 about the Z-axis 71 causes the at least one cutout portion 38 to engage the at least one wedge 36, thus rotating the lower ramp 20 about the Z-axis 71 (shown in FIG. 2) as well.

Figure 3:
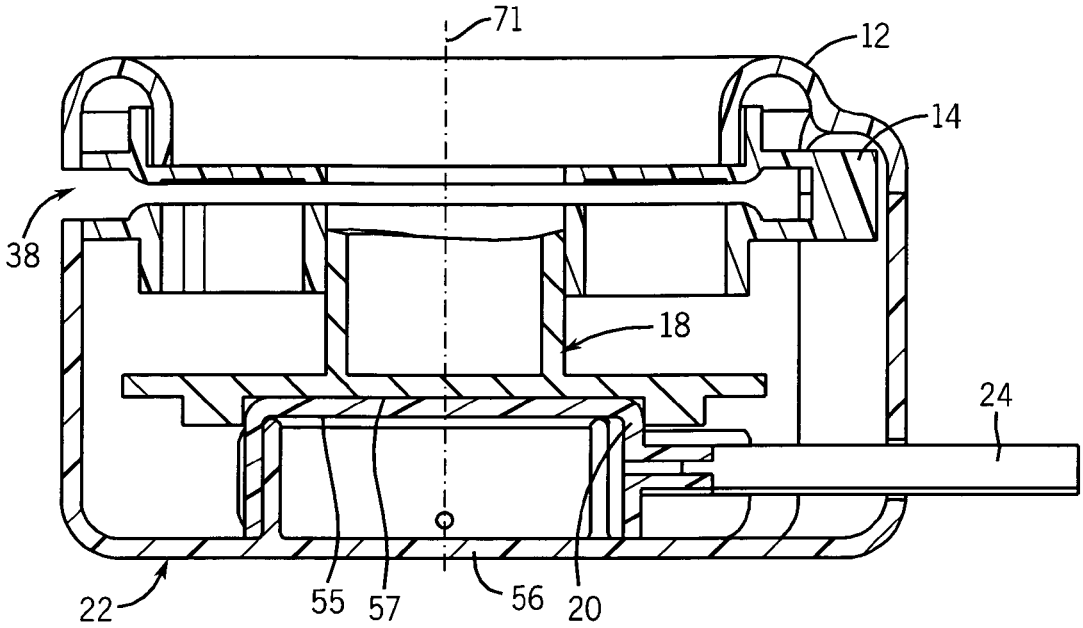
FIG. 3 is a cross-sectional view of a punch tool constructed according to a second embodiment of the present invention.
Figure 4:
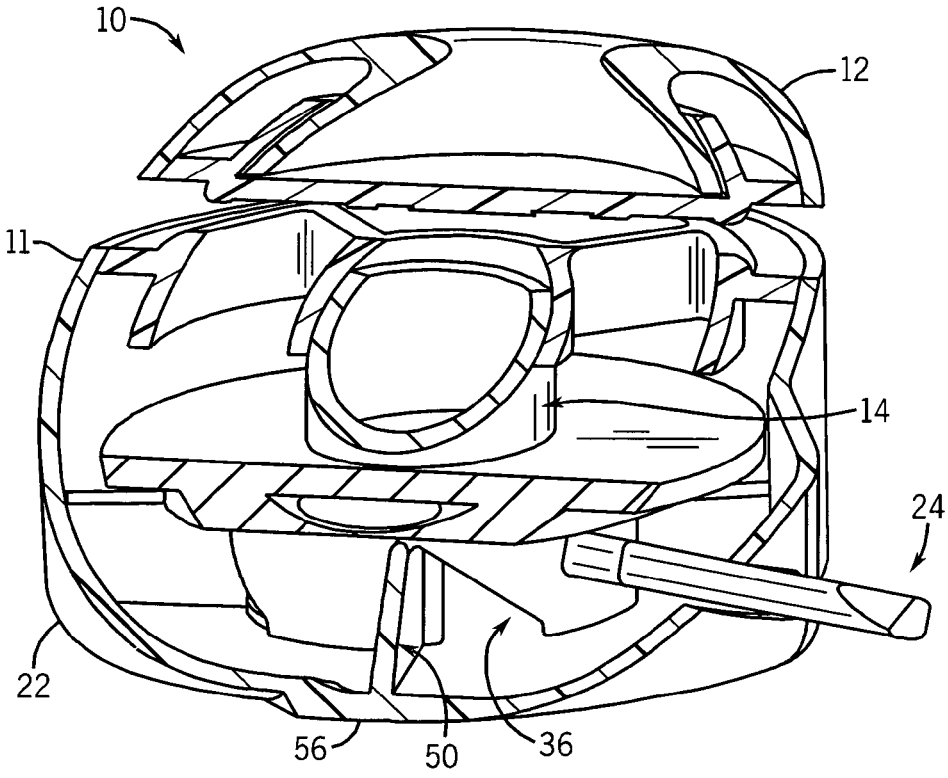
FIG. 4 is a diagonal cross-sectional view of a punch tool of FIG. 3.

In the embodiment illustrated in FIGS. 3 and 4, the punch 18 includes a mechanism for engaging the lower housing 22 to prevent rotational movement while allowing the punch 18 to engage the die 14. In another exemplary embodiment, the housing 11 includes an upper housing 12, a lower housing 22, and a lower ramp 20 having a first side 54 for engaging the punch 18 and a second side 55 for engaging the lower housing 22. The lower housing 22 includes a base 56 substantially perpendicular to the Z-axis 71, a sidewall 58 extending substantially from the perimeter of the base 56, and at least one rib 50, which is a vertical protrusion extending perpendicular from the base 56 of the lower housing 22 along the Z-axis 71. In one embodiment, the at least one rib 50 extends substantially the entire width of the base 56 of the lower housing 22 and passes through the center of the base 56. The lower ramp 20 includes at least one wedge 36 for engaging the at least one rib 50 of the lower housing 22. When the lower ramp 20 is rotated, the at least one wedge 36 engages the at least one rib 50, and the lower ramp 20 and the punch 18 positioned above it are raised along the Z-axis 71 relative to the upper housing 12, the lower housing 22, and the die 14.

In the embodiment shown in FIG. 1, the housing 11 includes a first handle 24 and a second handle 26. As shown in FIG. 2, the first handle 24 is fixedly attached to the upper ramp 16 and the second handle 26 is fixedly attached to the lower housing 22. As the upper ramp 16 (and lower ramp 20) are rotatable relative to the upper housing 12, punch and die 13, and lower housing 22, a mechanism for restricting the movement of the ramps is provided. In one embodiment, the upper housing 12 includes a first restriction tab 60 and a second restriction tab 61 which are positioned to engage the first handle 24 and the second handle 26 respectively. When the first handle 24 is positioned near the first restriction tab 60 and the second handle 26 is positioned near the second restriction tab 61, the punch 18 is in the lowered positioned, i.e., the peg 30 (FIG. 1) or rib 50 (FIG. 3) is positioned against the base of the lower housing 22 and the punch is disengaged from the die. As the first handle 24 and second handle 26 are brought in proximity to each other, the lower ramp 20 rotates and the punch 18 is raised to engage the die 14. In one embodiment, a biasing mechanism is used to maintain the first handle 24 and the second handle 26 in the "resting position" wherein the punch 18 is disengaged from the die 14. In a preferred embodiment, the first handle 24 is adapted to receive a first end of a spring 31 and the second handle 26 is adapted to receive a second end of the spring 31 for biasing the handles 24, 26.

One of ordinary skill in the art will appreciate that various sizes and types of dies and punches can be used with the punch tool of the present invention without departing from the spirit of the invention. For example, a punch tool of the present invention may be sized to fit in the palm of a users hand or alternatively may be sized for use on a desk or other work surface.

It should be understood that various changes and modifications to the embodiment described herein would be apparent to those skilled in the art. Such changes and modifications can be made without departing from the spirit and scope of the present invention and without demising its attendant advantages.

What is claimed is:

1. A punch tool comprising:

a housing having a lower portion, an upper portion, and a region between the upper portion and the lower portion for receiving a material to be punched, the lower portion and the upper portion moveably positionable relative to each other;

a punch and a die both at least partially disposed in the housing;

a lower ramp positioned between the punch and the lower portion of the housing and rotatable relative thereto about an axis of rotation, the lower ramp engageable with the punch upon rotation of the lower ramp; and an upper ramp positioned between the upper portion of the housing and the punch and rotatable relative thereto, the upper ramp engageable with the lower ramp, wherein rotation of the upper ramp results in rotation of the lower ramp and wherein rotation of the lower ramp results in movement of the punch within the housing in a direction substantially parallel to the axis of rotation, engaging the die.

2. The punch tool of claim 1, wherein the punch is rotationally fixed by engagement with the housing.

3. The punch tool of claim 1, further comprising a first handle coupled to the upper ramp and a second handle affixed to the housing, the first handle and the second handle movably positioned relative to each other, wherein the drawing of the first handle nearer to the second handle rotates the upper ramp.

4. The punch tool of claim 3, wherein the first handle and the second handle are movable relative to each other within a limited range sufficient to rotate the upper ramp to allow the punch to engage the die.

5. The punch tool of claim 4, wherein the first handle and the second handle are biased away from each other.

6. A punch tool comprising:

a housing having a lower portion, an upper portion, and a region between the upper portion and the lower portion for receiving a material to be punched, the lower portion and the upper portion moveably positionable relative to each other;

a punch and a die both at least partially disposed in the housing;

a lower ramp positioned between the punch and the lower portion of the housing and rotatable relative thereto about an axis of rotation, the lower ramp engageable with the punch upon rotation of the lower ramp;

a first handle coupled to the lower ramp and a second handle affixed to the housing, the first and second handle movably positioned relative to each other, wherein drawing the first handle nearer to the second handle rotates the lower ramp, wherein rotation of the lower ramp results in movement of the punch within the housing in a direction substantially parallel to the axis of rotation, engaging the die, and wherein the lower ramp is engageable with the lower portion of the housing and with the punch upon rotation of the lower ramp.

7. The punch tool of claim 6, wherein the first handle and the second handle are movable relative to each other within a limited range sufficient to rotate the upper ramp to allow the punch to engage the die.

8. The punch tool of claim 7, wherein the first handle and the second handle are biased apart from each other.

9. An invertible punch tool comprising:

a housing having a lower portion, an upper portion, and a region between the upper portion and the lower portion for receiving a material to be punched;

a punch rotationally fixed within the housing and a die, the punch and die at least partially disposed in the housing;

an upper ramp positioned between the upper portion of the housing and the punch and rotatable relative thereto and a lower ramp positioned between the punch and the lower portion of the housing and rotatable relative thereto; and the upper ramp engageable with the lower ramp whereby rotation of the upper ramp rotates the lower ramp and the lower ramp engageable with the punch upon rotation of the lower ramp, wherein rotation of the lower ramp results in movement of the punch within the housing, engaging the die.

10. The invertible punch tool of claim 9, further comprising a first handle coupled to the upper ramp and a second handle affixed to the housing, the first handle and second handle movably positioned relative to each other, wherein the drawing of the first handle nearer to the second handle rotates the upper ramp.

11. The invertible punch tool of claim 10, wherein the punch includes a plurality of protrusions and the mechanism for engaging the punch includes a plurality of wedges corresponding to the protrusions, wherein as the lower ramp rotates, the wedges engage the protrusions and raise the punch relative to the housing.

12. The invertible punch tool of claim 10, wherein the first handle and the second handle are movable relative to each other within a limited range sufficient to rotate the upper ramp to allow the punch to engage the die.

13. The invertible punch tool of claim 12, wherein the first handle and the second handle are biased away from each other.

14. An invertible punch tool comprising:

a housing having a lower portion, an upper portion, and a region between the lower portion and the upper portion for receiving a material to be punched;

a punch and a die at least partially disposed in the housing;

an upper ramp including a plurality of openings;

a lower ramp positioned between the punch and the lower portion of the housing and rotatable relative thereto about an axis of rotation, the lower ramp engageable with the punch and with the lower portion of the housing upon rotation of the lower ramp, the lower ramp including a plurality of wedges corresponding to the plurality of openings, wherein rotation of the lower ramp results in movement of the punch within the housing in a direction substantially parallel to the axis of rotation, engaging the die, and wherein as the lower ramp rotates, the plurality of wedges engage the plurality of openings and raise the lower ramp relative to the lower portion of the housing.

15. A punch tool comprising:

a housing having a lower portion, an upper portion, and a region between the upper portion and the lower portion for receiving a material to be punched;

a punch and a die both at least partially disposed in the housing;

a lower ramp positioned between the punch and the lower portion of the housing and rotatable relative thereto, the lower ramp engageable with the punch upon rotation of the lower ramp; and an upper ramp positioned between the upper portion of the housing and the punch and rotatable relative thereto, the upper ramp engageable with the lower ramp, wherein rotation of the upper ramp results in rotation of the lower ramp, and wherein rotation of the lower ramp results in movement of the punch within the housing, engaging the die.

16. A punch tool comprising:

a housing having a lower portion, an upper portion, and a region between the upper portion and the lower portion for receiving a material to be punched;

a punch and a die both at least partially disposed in the housing;

a lower ramp positioned between the punch and the lower portion of the housing and rotatable relative thereto, the lower ramp engageable with the punch upon rotation of the lower ramp;

a first handle coupled to the lower ramp; and a second handle affixed to the housing, the first and second handle movably positioned relative to each other, wherein drawing the first handle nearer to the second handle rotates the lower ramp, wherein rotation of the lower ramp results in movement of the punch within the housing, engaging the die, and wherein the lower ramp is engageable with the lower portion of the housing and with the punch upon rotation of the lower ramp.

17. The punch tool of claim 16, wherein the first handle and the second handle are biased apart from each other.

18. An invertible punch tool comprising:

a housing having a lower portion, an upper portion, and a region between the lower portion and the upper portion for receiving a material to be punched;

a punch and a die at least partially disposed in the housing;

a lower ramp positioned between the punch and the lower portion of the housing and rotatable relative thereto, the lower ramp engageable with the punch and with the lower portion of the housing upon rotation of the lower ramp;

a first handle coupled to the lower ramp; and a second handle affixed to the housing, the first handle and the second handle movably positioned relative to each other, wherein the drawing of the first handle nearer to the second handle rotates the lower ramp, and wherein rotation of the lower ramp results in movement of the punch within the housing, engaging the die.

19. The invertible punch tool of claim 18, wherein the first handle and the second handle are movable relative to each other within a limited range sufficient to rotate the upper ramp to allow the punch to engage the die.

20. The invertible punch tool of claim 19, wherein the first handle and the second handle are biased away from each other.

* * * * *